United States Patent [19]

Morozumi

[11] 4,370,299

[45] Jan. 25, 1983

[54] MOLYBDENUM-BASED ALLOY

[75] Inventor: Shotaro Morozumi, 12-504, Kawauchi-jutaku, Mubanchi, Kawauchi, Sendai-shi, Miyagi-ken, Japan

[73] Assignees: Tokyo Shibaura Denki Kabushiki Kaisha, Kawasaki; Shotaro Morozumi, Sendai, both of Japan

[21] Appl. No.: 280,352

[22] Filed: Jul. 6, 1981

[30] Foreign Application Priority Data

Jul. 8, 1980 [JP] Japan ..... 55-92198

[51] Int. Cl.[3] ..... C22C 27/04

[52] U.S. Cl. ..... 420/429; 148/11.5 F

[58] Field of Search ..... 75/176; 148/11.5 F

[56] References Cited

U.S. PATENT DOCUMENTS

| | | | |
|---|---|---|---|
| 2,188,405 | 1/1940 | Hensel et al. | 75/176 |
| 2,678,268 | 5/1954 | Ham et al. | 75/176 |
| 2,678,269 | 5/1954 | Ham et al. | 75/176 |
| 2,678,272 | 5/1954 | Ham et al. | 75/176 |
| 2,883,283 | 4/1959 | Wainer | 75/176 |

OTHER PUBLICATIONS

Harwood, The Metal Molybdenum, Proceedings of a Symposium sponsored by Office of Naval Research Dept. of Navy, Sep. 18, 1956, pp. 96–103.

*Primary Examiner*—Peter K. Skiff

*Attorney, Agent, or Firm*—Cushman, Darby & Cushman

[57] ABSTRACT

A molybdenum-based alloy contains 0.001 to 0.5% of scandium. This alloy allows working at relatively low temperatures.

7 Claims, 2 Drawing Figures

MOLYBDENUM-BASED ALLOY

I. FIELD OF THE INVENTION

Figure 1:
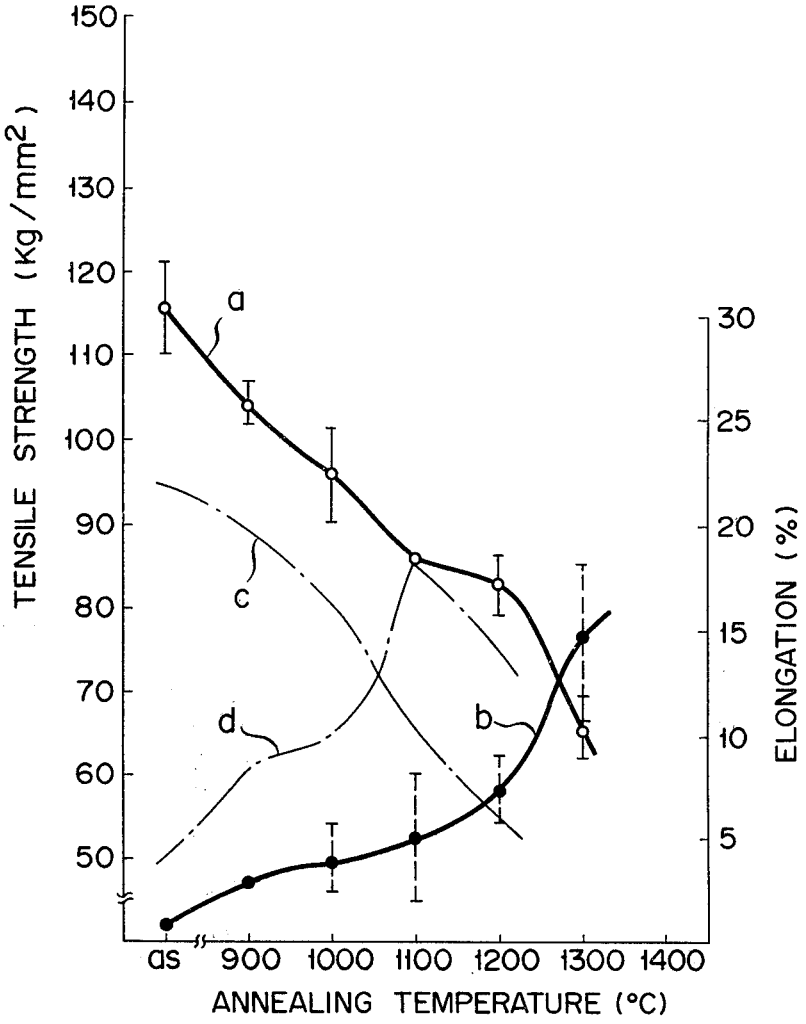

The present invention relates to a molybdenum-based alloy and, more particularly, to a molybdenum-based alloy with excellent workability.

II. DESCRIPTION OF THE PRIOR ART

Molybdenum is known to have excellent resistance against high temperatures and is used for heat-resistant structural parts or as lamp bulb materials. However, molybdenum as cast has a relatively high ductile-brittle transition temperature and poor ductility, and requires working at high temperatures such as 1,400° C. Although the transition temperature of molybdenum can be lowered by working such as forging, it is only lowered slightly, resulting in the requirement of high temperatures for working.

Studies for improving the physical properties of molybdenum have been made according to two different principles.

According to one of these principles, improvements in the properties of molybdenum are sought so that forged molybdenum material may have excellent ductility under practical circumstances even though its workability is not very good. For the purpose of attaining these improvements, experiments have been conducted in which to molybdenum are added Al, B, C, Ce, Co, Fe, Hf, Re, Ru, Si, Th, Ti, V, Y and Zr. These experiments revealed that the addition in certain amounts of Al, B, C, Ce, Re, Ru, Ti, Th, V and Zr lowers the ductile-brittle transition temperature after forging to below room temperature. Among the elements added, the effects of Re are most significant and are known as rhenium effects. However, the amount of Re to be added is as large as 20 to 50%. Addition of Re in such a large amount indicates that the addition of Re to Mo is intended to change the essential properties of the alloy. It is further known that the addition of Th in an amount of about 10% lowers by a maximum of 100° C. the ductile-brittle transition temperature of molybdenum after casting without further processing (i.e., as cast). It is also known that the addition of elements, other than Re and Th, in amounts of 0.005 to 1.0% provide similar effects as the addition of Th.

However, even when the ductile-brittle transition temperature has been lowered, it does not necessarily mean excellent workability in hot working. This is because the workability in hot working largely depends upon the properties of grain boundaries of the material. Even with a molybdenum ingot as cast, considerably good ductility is known to be obtainable when it is sufficiently forged and the texture is broken. However, when the oxygen contained in an ingot segregates into the grain boundaries of the solidified ingot, the ingot becomes brittle so that the temperature for hot working must be elevated for working such an ingot.

The other principle aims at lowering the temperature for hot working of molybdenum or a molybdenum-based alloy.

Studies for lowering the hot working temperature are far less numerous than the studies for lowering the ductile-brittle transition temperature. A report is known according to which addition of B and/or C lowers the hot working temperature.

For example, "Grain Refinement and Improved Ductility in Molybdenum by Small Boron Additions" by A. D. Zumbrunnen and J. M. Fitzpatrick, J. Less-Common Metals, 7(1964) pp. 356 and 357, reports that B was added within a range of 10 to 500 p.p.m. to molybdenum containing 1,000 p.p.m. of O, 10 p.p.m. or less of C, and 10 to 14 p.p.m. of N. The molybdenum was irradiated with an electron beam to melt and prepare a molybdenum ingot containing 15 to 20 p.p.m. of O, 10 to 16 p.p.m. of C, 10 to 14 p.p.m. of N and 10 to 50 p.p.m. of B. The molybdenum ingot thus obtained could be worked at a temperature of 1,200° C. According to the experiment of this report, since the electron beam melting method was adopted, the O content became 23 p.p.m. even when no elements were added. Although the amounts of C and N do not change, it is seen that the workability in hot working is improved.

An article entitled "Effects of Addition of B on Properties of Arc-melts Mo" by Tadashi Hosoda and Toshio Matoba in Nihon Kinzoku Gakkai-shi (1966), Vol. 3, pp. 231 to 237, describes a case wherein B was added in an amount of 0.02 to 0.1% by weight to the molybdenum powder, the mixture was melted by an electron beam, and rolling was repeated at 800° C. for attaining a draft of above 80%. An article entitled "Effects of Composite Addition of 0.15 wt% of Ru, C and B on Ductility of Molybdenum Ingot" in Nihon Kinzohu Gakkai-shi (1973) Vol. 1, pp. 118 to 126, describes that molybdenum ingots prepared by composite addition of B and C and further addition of Ru exhibit very good ductility at a high temperature of 1,200° C. It goes on to describe, however, that cracks form in the ingot under working at temperatures below this specific temperature.

Although these various studies have been made to improve the properties of molybdenum, satisfactory results in terms of improvements in workability have not yet been obtained.

It is, therefore, the primary object of the present invention to provide a molybdenum-based alloy which exhibits excellent workability at relatively low temperatures.

It is another object of the present invention to provide a molybdenum-based alloy which has excellent mechanical strength at high temperatures.

In order to achieve these and other objects which may become apparent from the description to follow, the present invention provides a molybdenum-based alloy consisting essentially of 0.001 to 0.5% by weight of scandium with the remainder being essentially molybdenum.

As has been already described, molybdenum generally exhibits poor workability, and cracks form mainly at the grain boundaries during hot working. The formation of these cracks is considered to be mainly attributable to precipitation or segregation of impurities present in small amounts, especially oxides or carbides. Especially with a molybdenum ingot as cast, the crystal grains are extremely coarse, so that the above-mentioned impurities may significantly exert an influence on intergranular embrittlement. Scandium which is added to molybdenum according to the present invention shows a strong deoxidation tendency and thus especially reduces oxides among the impurities which precipitate or segregate into the grain boundaries. For this reason, the molybdenum-based alloy of the present invention does not exhibit intergranular embrittlement even at relatively low temperatures and thus allows various types of working such as forging, rolling, swaging, and drawing in an excellent manner (i.e., working is easy and cracks do not form) at relatively low temperatures (e.g., 800° C. or less). In addition to this, the molybdenum-based alloy of the present invention exhibits low reduction in strength and hardness and even better elongation at high temperatures. As a result, the alloy of the present invention has excellent resistance to stress.

The molybdenum-based alloy of the present invention may also contain Co, Cr, Fe, Fe, Re, V, Nb, Ti, W, Zr, B and the like.

Figure 2:
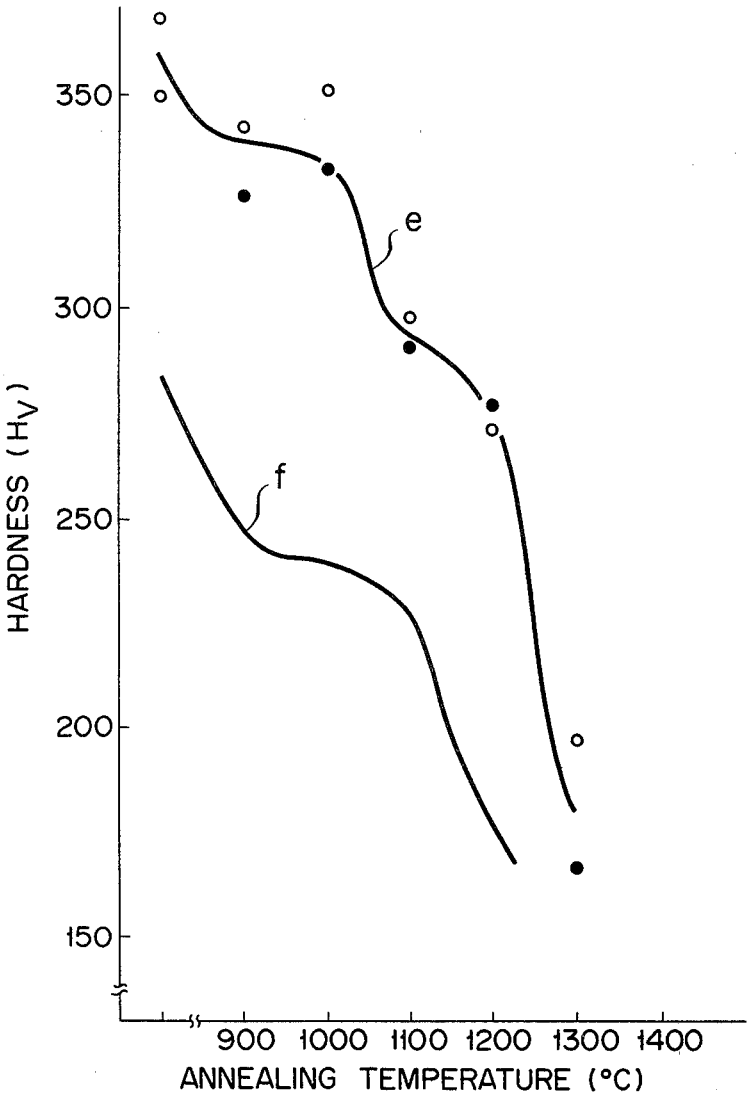

This invention can be more fully understood from the following detailed description when taken in conjunction with the accompanying drawings, in which:

FIG. 1 is a graph showing the relationship between the annealing temperature, and tensile strength and elongation of the alloy of the present invention together with those of commercially available pure molybdenum, and FIG. 2 is a graph showing the relationship between the annealing temperature and hardness of the alloy of the present invention together with those of the commercially available pure molybdenum.

The present inventors have made extensive studies for the purpose of improving the workability at relatively low temperatures of molybdenum as cast. In order to reduce especially the oxides among the impurities which precipitate or segregate into the grain boundaries of Mo, various elements were added to molybdenum and the workability of the resultant molybdenum-based alloys at relatively low temperatures was examined. As a result of these studies, it has been found that scandium has strong affinity for oxygen and that the addition of scandium largely improves the workability of the molybdenum-based alloy, thus establishing the present invention.

As has been already described, the molybdenum-based alloy of the present invention contains 0.001 to 0.5% by weight of scandium. When the scandium content deviates from this range, cracks tend to form during working at relatively low temperatures (e.g., 800° C.).

The remaining portion of the alloy of the present invention consists essentially of molybdenum. However, molybdenum as a raw material generally unavoidably contains impurities such as carbon, oxygen, nitrogen and so on. However, the impurity contents in the alloy of the present invention are preferably no more than 0.025% for C, no more than 0.0015% for O, and no more than 0.0010% for N. Impurities other than those specified above, such as Ca, Mg, Ni and Cu, are preferably contained in the alloy in as small amounts as possible.

The improving effects of workability obtained with scandium may still be obtained with a molybdenum containing 1% or less of Co and Fe; 30% or less of Re; 0.5% or less of Ru; 10% or less of V, Nb, Cr and Ti; 50% or less of W; and 0.5% or less of Zr and/or 0.001 to 0.1% of B.

A method for preparing an alloy of the present invention will now be described.

Molybdenum as a principal raw material of the alloy of the present invention may be a commercially available powder of pure molybdenum, and preferably contains the smallest possible amounts of C, O and N, as described above. The scandium raw material to be added to the alloy of the present invention may be a metal scandium powder or a scandium compound such as a scandium hydride, a scandium halogenide, a scandium hydroxide, a scandium boride, a scandium carbide, or a scandium intermetallic compound such as Sc-V. However, it is most advantageous to use as the scandium-containing raw material a scandium hydride which may be available at relatively inexpensive cost in powder form and which contains hydrogen having a strong tendency for reduction.

The above-mentioned molybdenum powder and the scandium-containing raw material powder are well mixed together with the other alloy components or elements mentioned above, if desired, and pressed to provide a green compact which is then melted in a non-oxidizing atmosphere. Before these procedures, it is preferable to subject the raw material molybdenum powder to treatment in wet hydrogen to sufficiently remove the oxygen on the surface. The melting may be performed in an arc furnace having non-consumable or consumable type electrodes, or it may be performed by heating with an electron beam or a plasma arc. It is preferable to maintain the mixture in the molten state for a sufficient time to allow scandium and oxygen to react fully. The resultant slag is removed from the molten mass which is then cast to provide an ingot of the molybdenum-based alloy of the present invention. In this melting method, the amount of the scandium-containing raw material to be used must be sufficient (e.g., the amount that added scandium accounts for 0.1 to 1.0% by weight) so that the scandium content in the resultant alloy is 0.001 to 0.5%. Although the amount of the scandium-based raw material to be added differs depending upon the amount of oxygen contained in the molybdenum, it may be easily determined by performing a preliminary test. The content of the remaining scandium is preferably 0.2% or less.

Although the alloy of the present invention may be generally prepared by the melting method as described above, it may alternatively be prepared by sintering the green compact described above to provide a sintered ingot.

With the ingot or sintered ingot of the alloy of the present invention, the workabilty is better and cracks do not form during forging or rolling at relatively low temperatures such as 800° C., unlike the ingot or sintered ingot of the prior art molybdenum-based alloys. The rate of decrease in the ductile-brittle transition temperature in forging is also great with the alloy of the present invention and shows, for example, a transition temperature around room temperature at a 50% draft.

Examples of the present invention will now be described.

EXAMPLE 1

Commercially available 99.97% pure molybdenum powder was subject to treatment in wet hydrogen at 900° C. To these powder samples were individually added scandium hydride powder in scandium equivalents of 0%, 0.05%, 0.1%, 0.2%, 0.3%, 0.4%, 0.5% and 1.0%. After the samples were each well mixed, they were pressed to provide green compacts of about 40 g weight. These green compaacts were arc-melted by tungsten electrodes in an argon atmosphere to provide 8 different kinds of button-shaped ingots. The contents of remaining scandium in the respective ingots are shown in Table 1 as contrasted with the contents of scandium added to the green compacts.

TABLE 1

| Sample No. | Sc added content (%) | Sc remaining content (%) | Workability |
|---|---|---|---|
| 1 | 0 | 0 | X |
| 2 | 0.05 | Less than 0.001 | X |
| 3 | 0.1 | 0.003 | O |
| 4 | 0.2 | 0.06 | O |
| 5 | 0.3 | 0.09 | O |
| 6 | 0.4 | 0.12 | O |
| 7 | 0.5 | 0.19 | O |
| 8 | 1.0 | 0.42 | O |

The top and bottom surfaces of these 8 different kinds of ingots were ground to provide plates of about 8 mm thickness. They were then forged to a thickness of 3 mm at temperatures between 400° and 1,000° C., in increments of 100° C. They were then rolled at the respective temperatures to provide plates of 1 mm thickness.

As a result, cracks formed at the respective temperatures in samples No. 1 and 2, that is, the sample with no scandium added and the sample with 0.05% added scandium and less than 0.001% remaining. However, samples No. 2 to 8 provided excellent working samples in which cracks did not form at all at the temperatures tested. It follows from this that addition of scandium contributes to improving the workability of molybdenum. It has also been found that when the remaining scandium content exceeded 0.5%, cracks tended to form unless the lowest working temperature was elevated. Marks o and x in Table 1 respectively indicate excellent and poor workability of the sampless obtained.

EXAMPLE 2

A 99.90% pure Mo powder was treated in wet hydrogen at 900° C. After adding a scandium hydride powder to the Mo powder, the mixture was mixed well in a V-type mixer for 2 hours. The mixture was arc-melted with non-consumable type tungsten electrodes in an argon atmosphere to provide an ingot of 30 mm thickness, 30 mm width, and 70 mm length. This ingot was forged within a temperature range of 700° to 1,300° C. to reduce the thickness from 30 mm to 11 mm at the first step and then from 11 mm to 5 mm at the second step. Next, the ingot was hot-worked at a draft of 74% within a temperature range of 700° to 1,300° C. to reduce the thickness from 5 mm to 1.3 mm. Thereafter, the ingot was held at 900° C. for 20 minutes and was annealed. The annealed ingot was then cold-worked at a draft of 75% to reduce the thickness from 1.3 mm to 0.33 mm.

The working material of 0.33 mm thickness and annealed materials obtained by annealing this working material for 20 minerals at 900°, 1,000°, 1,100°, 1,200°and 1,300° C., respectively, were cut to provide test pieces and were subjected to a tensile strength test.

FIG. 1 shows the relationship between the annealing temperature and the tensile strength or elongation of the samples. Referring to this figure, curves (a) and (b) correspond to the alloy of the present invention and show the relationship between the annealing temperature and the tensile strength and between the annealing temperature and the elongation of a sample having a 0.034% remaining scandium content. Curves (c) and (d) show the relationship between the annealing temperature and the tensile strength and between the annealing temperature and the elongation for a sample obtained by similarly hot working, annealing, and cold working a molybdenum sintered body for electric appliances (99.90% or higher in purity), as defined by JIS H 4483.

As may be seen from curve (a), the tensile strength of the alloy of the present invention with respect to the annealing temperatures above 1,100° C. is smaller in drop rate than with that represented by curve (c) of the prior art commercially available molybdenum. This seens attributable to the fact that the recrystallization temperature of the alloy of the present invention is higher by 100° to 200° C. than that of the prior art molybdenum. As may be seen from curve (b), the elongation of the alloy of the present invention is small in absolute value at the same annealing temperature as compared with that represented by curve (d) of the prior art commercially available molybdenum. However, when the annealing temperature is higher, the elongation of the alloy of the present invention becomes greater while the elongation of the commercially available pure molybdenum is decreased at temperatures above 1,100° C. It is seen from this that the alloy of the present invention is stable in strength at high temperatures. Therefore, the alloy of the present invention exhibits better resistance than the commercially available pure molybdenum upon being repeatedly subjected to stress at high temperatures.

The relations between the annealing temperature and hardness (Hv) of the samples of the alloy of the present invention and the commercially available pure molybdenum (JIS H 4483) are shown in FIG. 2. Referring to this figure, curve (e) corresponds to an alloy of the present invention. Marks o represent the relationship between the hardness (Hv) and the annealing temperature for the side face along the direction of rolling of the sample in the final cold working, and marks • represent the relationship between the hardness (Hv) and the annealing temperature for the end face of the sample along the direction of rolling. Curve (f) corresponds to a commercially available molybdenum.

Referring to FIG. 2, although with both samples the hardness decreased as the annealing temperature was elevated, the hardness of the alloy of the present invention is far greater than that of the prior art molybdenum at the same annealing temperature.

It is seen from these experiments that the alloy of the present invention, although work-hardened, exhibits excellent workability as compared with the prior art pure molybdenum.

In the examples described above, the properties of ingots obtained by arc-melting in an argon atmosphere using non-consumable type electrodes were examined. However, similar experiments were also conducted for sintered ingots of the alloy of the present invention which were obtained by uniformly mixing the molybdenum powder and the scandium-containing compound powder compressing to provide a green compact, and sintering the green compact to attain a substantially uniform single phase texture. These ingots were similarly hot-worked, cold-worked, and annealed, and the various properties of the samples obtained therefrom were examined. These samples showed substantially the same properties as the samples of the ingot of the alloy of the present invention previously described.

EXAMPLE 3

Molybdenum-based alloys of the compositions as shown in Table 2 were prepared according to the same procedures of Example 1, and the forgeability and rollability of these alloys were examined. The obtained results are shown in Table 2 wherein mark o indicates an evaluation of excellent , mark Δ indicates good, and mark x indicates poor.

TABLE 2

| Composition, % by weight | | | | | | | Forge-ability | Rollability | |
|---|---|---|---|---|---|---|---|---|---|
| Zr | V | Nb | Ti | B | Sc | Mo | 1,000° C. | 600° C. | 400° C. |
| 0.05 | | | | | 0.2 | Remainder | O | O | O |
| 0.15 | | | | | 0.2 | Remainder | O | O | Δ |
| 0.3 | | | | | 0.2 | Remainder | O | O | Δ |
| 0.05 | | | | | 0.4 | Remainder | O | O | Δ |
| 0.1 | | | | 0.05 | 0.2 | Remainder | O | O | O |
| 0.1 | | | | 0.1 | 0.2 | Remainder | O | Δ | Δ |
| 0.2 | | | | 0.02 | 0.2 | Remainder | O | O | Δ |
| 0.2 | | | | 0.07 | 0.2 | Remainder | O | O | Δ |
| 0.5 | | | | 0.003 | 0.2 | Remainder | O | O | Δ |
| 0.5 | | | | 0.005 | 0.2 | Remainder | O | Δ | Δ |
| 0.5 | | | | 0.01 | 0.2 | Remainder | O | Δ | Δ |
| 0.5 | | | | 0.05 | 0.2 | Remainder | O | O | O |
| | 0.1 | | | | 0.2 | Remainder | O | O | O |
| | 0.5 | | | | 0.2 | Remainder | O | O | O |
| | 1.0 | | | | 0.2 | Remainder | O | O | O |
| | 0.1 | | | 0.001 | 0.2 | Remainder | O | O | O |
| | 0.5 | | | 0.001 | 0.2 | Remainder | O | O | O |
| | 1.0 | | | 0.001 | 0.2 | Remainder | O | O | Δ |
| | 0.1 | | | 0.003 | 0.2 | Remainder | O | O | Δ |
| | 0.5 | | | 0.003 | 0.2 | Remainder | O | O | Δ |
| | 1.0 | | | 0.003 | 0.2 | Remainder | O | O | Δ |
| | 1.0 | | | 0.005 | 0.2 | Remainder | O | O | O |
| | 0.5 | | | 0.005 | 0.2 | Remainder | O | O | Δ |
| | 1.0 | | | 0.05 | 0.2 | Remainder | O | O | O |
| (Control) | 0.1 | | | | | Remainder | X | — | — |
| (Control) | 0.1 | | | 0.001 | | Remainder | X | — | — |
| | | 0.1 | | | 0.2 | Remainder | O | O | O |
| | | 0.5 | | | 0.2 | Remainder | O | O | O |
| | | 1.0 | | | 0.2 | Remainder | O | O | O |
| | | 0.1 | | 0.001 | 0.2 | Remainder | O | O | O |
| | | 0.5 | | 0.001 | 0.2 | Remainder | O | O | O |
| | | 1.0 | | 0.001 | 0.2 | Remainder | O | O | O |
| | | 0.1 | | 0.003 | 0.2 | Remainder | O | O | O |
| | | 0.5 | | 0.003 | 0.2 | Remainder | O | O | Δ |
| | | 1.0 | | 0.003 | 0.2 | Remainder | O | O | Δ |
| | | 0.1 | | 0.005 | 0.2 | Remainder | O | O | Δ |
| | | 0.5 | | 0.005 | 0.2 | Remainder | O | O | O |
| | | 1.0 | | 0.005 | 0.2 | Remainder | O | O | Δ |
| (Control) | | 0.1 | | | | Remainder | X | — | — |
| (Control) | | 0.1 | | 0.001 | | Remainder | X | — | — |
| | | | 0.1 | | 0.1 | Remainder | O | O | O |
| | | | 0.2 | | 0.1 | Remainder | O | O | O |
| | | | 0.4 | | 0.1 | Remainder | O | O | O |
| | | | 0.1 | | 0.2 | Remainder | O | Δ | Δ |
| | | | 0.2 | | 0.2 | Remainder | O | O | O |
| | | | 0.4 | | 0.2 | Remainder | O | O | Δ |
| (Control) | | | 0.1 | | — | Remainder | X | — | — |
| 0.05 | | | 0.1 | | 0.1 | Remainder | O | O | Δ |
| 0.05 | | | 0.2 | | 0.1 | Remainder | O | O | Δ |
| 0.15 | | | 0.1 | | 0.1 | Remainder | O | O | Δ |
| 0.15 | | | 0.2 | | 0.1 | Remainder | O | O | Δ |
| 0.05 | | | 0.1 | | 0.2 | Remainder | O | O | O |
| 0.05 | | | 0.2 | | 0.2 | Remainder | O | O | O |
| 0.15 | | | 0.1 | | 0.2 | Remainder | O | O | Δ |
| 0.15 | | | 0.2 | | 0.2 | Remainder | O | Δ | O |
| 0.05 | | | 0.1 | | 0.4 | Remainder | O | O | O |
| 0.05 | | | 0.2 | | 0.4 | Remainder | O | O | O |
| 0.15 | | | 0.1 | | 0.4 | Remainder | O | O | Δ |
| 0.15 | | | 0.2 | | 0.4 | Remainder | O | O | Δ |

It is considered that the workability at relatively low temperatures is improved with the alloys of the present invention since the addition of scandium results in sufficient deoxidation and therefore a reduction in precipitation of oxides or the like in the grain boundaries. It is further considered that the addition of scandium not only contributes to deoxidation but also to improving other properties such as workability, tensile strength, elongation and hardness (Hv) of the alloy of the present invention, although the reasons for this remain unknown.

Since the alloy of the present invention is excellent in workability, especially drawing and swaging, lamp bulb parts may be conveniently manufactured from plates of the alloy of the present invention and wires may also be manufactured. Further, considering the tendency of the tensile strength, elongation and hardness to change upon annealing, the mechanical strength of the heat-resistant members using molybdenum plates may be improved by the use of the alloy of the present invention. Finally embrittlement of prior art molybdenum material upon irradiation by neutrons for nuclear power may be significantly reduced by using the alloy material of the present invention.

What is claimed is:

1. A molybdenum-based alloy with excellent hot workability consisting essentially of 0.001 to 0.5% by weight of scandium and the remainder essentially of molybdenum.

2. An alloy according to claim 1, wherein scandium is contained in a maximum amount up to 0.2% by weight.

3. An alloy according to claim 1, further consisting of at least one element selected from the group consisting of Co, Cr, Fe, Re, Ru, V, Nb, Ti, W, Zr and B.

4. An alloy according to claim 1 or 2, comprising 10% or less of Nb.

5. An alloy according to claim 1 or 2, comprising 10% or less of V.

6. An alloy according to claim 1, comprising 10% or less of Ti.

7. An alloy according to claim 1, comprising of 0.001 to 0.1% of B.

* * * * *